United States Patent [19]

Acquaviva

[11] 4,217,716

[45] Aug. 19, 1980

[54] STREET SIGN STRUCTURE

[76] Inventor: Pompeli F. Acquaviva, P.O. Box 231, South Yarmouth, Mass. 02644

[21] Appl. No.: 832,783

[22] Filed: Sep. 12, 1977

[51] Int. Cl.[2] ..... G09F 15/00

[52] U.S. Cl. ..... 40/607; 403/400

[58] Field of Search ..... 403/346, 389, 400, 403; 40/607, 606; 248/219.2

[56] References Cited

U.S. PATENT DOCUMENTS

| | | | |
|---|---|---|---|
| 716,098 | 12/1902 | Plumbley | 40/607 |
| 876,754 | 1/1908 | Warner | 40/607 |
| 1,220,716 | 3/1917 | Beery | 40/607 |
| 1,335,870 | 4/1920 | Andresen | 40/607 |
| 1,734,407 | 11/1929 | Taussig | 40/11 R X |
| 2,839,660 | 6/1960 | Aitkens | 40/10 R X |
| 2,865,588 | 12/1948 | McCartney | 40/1 |
| 3,256,030 | 6/1966 | Banse | 287/20.94 |
| 3,469,520 | 9/1969 | Foy et al. | 248/219.2 X |
| 3;831,338 | 8/1974 | Klingesmith et al. | 403/400 |

*Primary Examiner*—Louis G. Mancene
*Assistant Examiner*—Wenceslao J. Contreras
*Attorney, Agent, or Firm*—Norman S. Blodgett; Gerry A. Blodgett

[57] ABSTRACT

Street sign structure, including two signs held at a right angle at vertically-spaced levels and a connector element joining the signs and consisting of an upper panel attached to the upper sign and a lower panel attached to the lower sign with an integral connector joining the two panels.

9 Claims, 15 Drawing Figures

STREET SIGN STRUCTURE

BACKGROUND OF THE INVENTION

In the design and operation of street sign equipment, it has been common practice to make use of cast metal fittings for joining the signs to each other and to the post. Such fittings are expensive to manufacture and, because of their irregular bulky shape, do not store and ship in a compact manner. Attempts have been made in the past to use fittings formed of sheet metal, but metal fittings have not only been easily damaged, but have been subject to a great deal of corrosion. Furthermore, in many cases their appearance has been pleasing. Also, they have been easily damaged and subject to considerable pilferage. These and other difficulties experienced with the prior art devices have been obviated in a novel manner by the present invention.

It is, therefore, an outstanding object of the invention to provide street sign structure which is simple and inexpensive to manufacture.

Another object of this invention is the provision of a street sign structure which is particularly adapted to standardization throughout a municipality.

A further object of the present invention is the provision of a street sign structure which, although inexpensive to manufacture, has a pleasing appearance.

It is another object of the instant invention to provide a street sign structure whose main element nests readily and, therefore, is storable and shippable in a small container.

A still further object of the invention is the provision of a street sign structure in which the major elements are stamped from sheet metal and which are not easily subject to deterioration by the elements or subject to vandalism or pilferage.

It is a further object of the invention to provide a street sign structure, including fastening means which can be readily applied, but which is difficult if not impossible to remove by an unauthorized person.

With these and other objects in view, as will be apparent to those skilled in the art, the invention resides in the combination of parts set forth in the specification and covered by the claims appended hereto.

SUMMARY OF THE INVENTION

In general, the present invention consists of a street sign structure for use in supporting two flat rectangular signs at the right angle one above the other on a post. A connector element includes a flat rectangular upper portion is provided having two apertures for connection through the lower edge of the upper sign. A flat rectangular lower portion is provided having two apertures for connection to the upper edge part of the lower sign. A connector portion is provided consisting of two square panels integrally joined at a right angle, the upper edge of one of the panels being integrally connected to the lower edge of the upper portion and the lower edge of the other panel being integrally connected to the upper edge of the lower portion.

More specifically, the two panels are joined along less than their entire heights, so that there is a first gap between the lower edge of the said one of the panels and the upper edge of the said other panel and the lower edge of the said upper portion.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
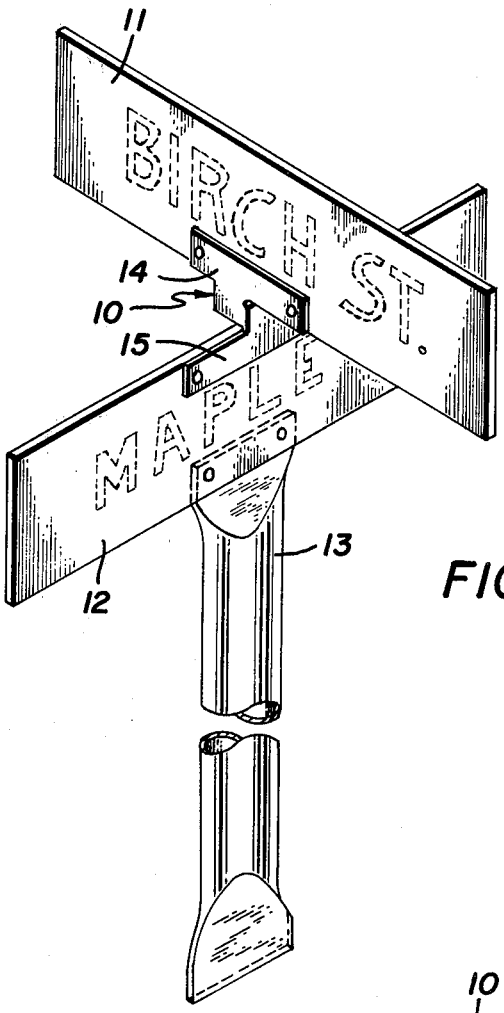
FIG. 1 is a perspective view of a street sign structure embodying the principles of the present invention.
Figure 2:
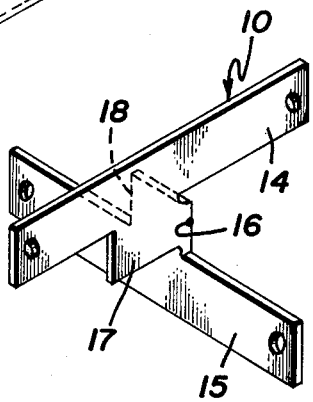
FIG. 2 is a perspective view of a connector portion of the structure.
Figure 3:
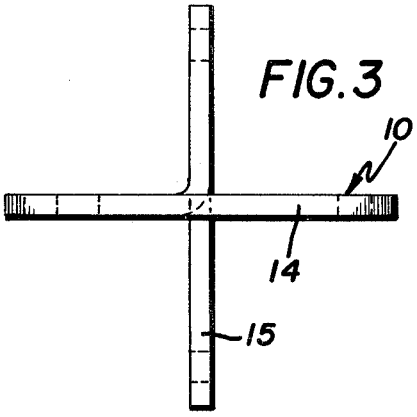
FIG. 3 is a plan view of the connector element.
Figure 4:
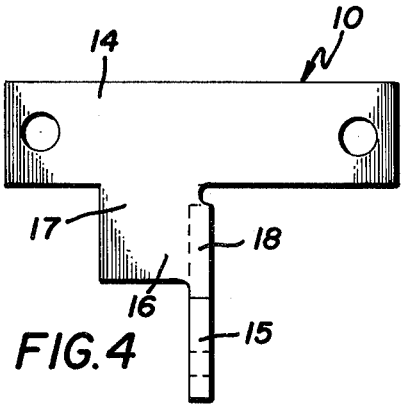
FIG. 4 is a front elemental view of the connector element.

Referring first to FIG. 1, wherein are best shown the general features of the invention, the street sign structure, indicated generally by the reference numeral 10, is shown in use in supporting two street signs 11 and 12 at a right angle to one another on a post 13. The signs are joined by a connector element having a flat rectangular upper portion 14 which is fastened to the lower edge of the upper sign 11 by means of two apertures. A flat rectangular lower portion 15 is also provided with two apertures for attachment to the upper part of the lower sign 12. A connector portion 16 is provided consisting of two somewhat square panels 17 and 18 integrally joined at a right angle. The upper edge of the panel 17 is integrally joined to the lower edge of the upper portion 14, while the lower edge of the lower panel 18 is joined to the upper edge of the lower portion 15 of the connector element.

As is evident in FIGS. 2–5, the two panels 17 and 18 are joined along a portion of their heights, so that there is a first gap 19 between the lower edge of the upper panel 17 and the upper edge of the lower portion 15, while a second gap 21 exists between the upper edge of the other panel 18 and the lower edge of the upper portion 14.

Figure 5:
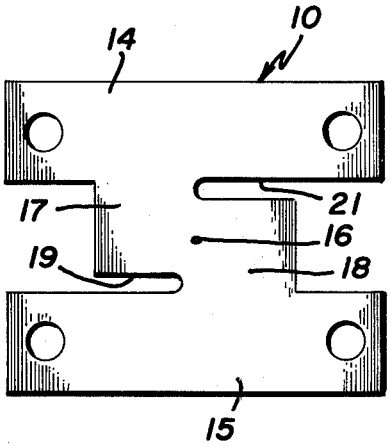
FIG. 5 is a front elevational view of a sheet metal blank from which the connector element is formed.

FIG. 5 shows the blank from which the connector element is formed.

Figure 8:
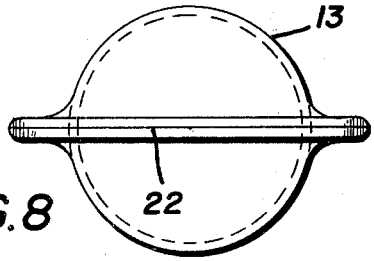
FIGS. 6, 7, and 8 are front elevational, side elevational, and plan views, respectively, of one end of a post forming part of the present invention.
Figure 6:
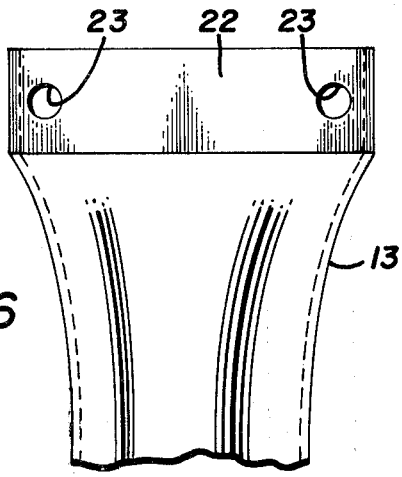
Figure 7:
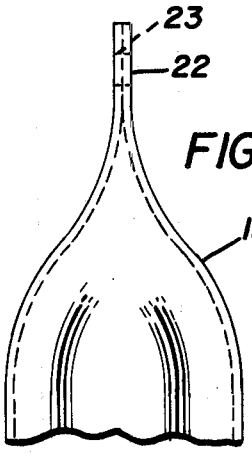

Referring to FIGS. 6, 7, and 8, it can be seen that the post 13 is tubular and of circular cross section. The upper end of the post is deformed to provide a generally rectangular flat portion 22, having two apertures 23 by which means it is attached to the lower end of the bottom sign 12. The lower end of the post is formed in the same manner as the top end.

Figure 11:
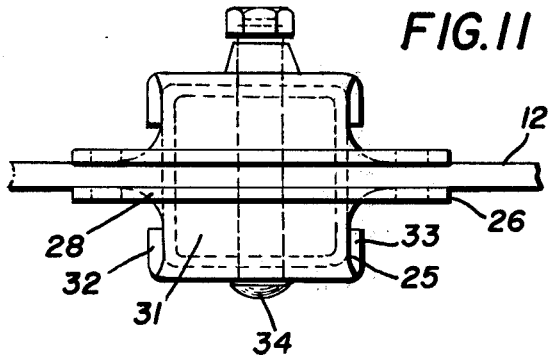
FIGS. 9, 10, and 11 are front elevational, side elevational, and plan views, respectively, of a modified form of the invention.
Figure 9:
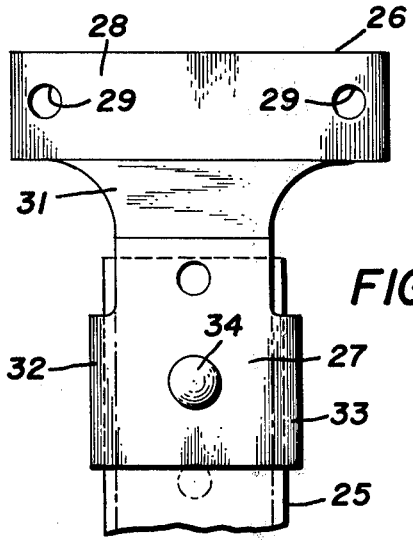
Figure 10:
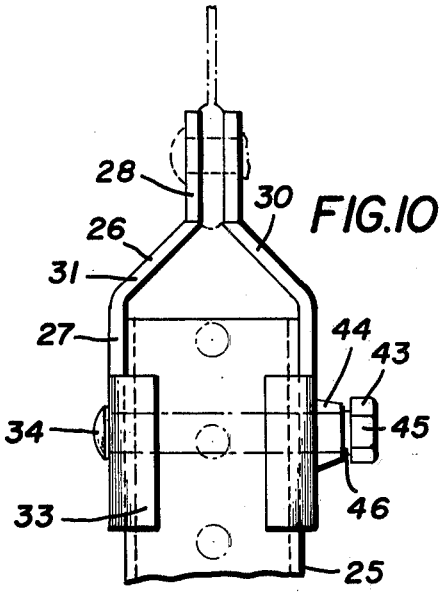

In the modified form of the invention shown in FIGS. 9, 10, and 11, it can be seen that the post 25 is tubular and of square cross-section and is provided with a vertical row of apertures extending down each of two opposite sides. A connector 26 is provided having a flat main body 27 adapted to be bolted to one surface of the post 25. It also has a rectangular plate 28 formed with two apertures 29 for attachment to the lower part of the lower sign 12. A neck 31 extends between the main body 27 and the rectangular plate 28 at a substantial angle to both to hold them in spaced parallel relationship. Two tabs 32 and 33 are provided, each extending at a right angle to the main body 27. The main body is fastened by a bolt 34 to one exterior side surface of the post 25 with the tabs 32 and 33 lying flat against the opposite parallel side surface of the post adjacent the said one side surface. The neck 31 extends in the same angular direction as the tabs so that the rectangular plate 28 resides in a plane extending generally centrally of the post 25. Another similar connector 30 is provided of a similar type, but extending from the other side of the post, so that the signal 12 is embraced between the two rectangular plates.

Figure 12:
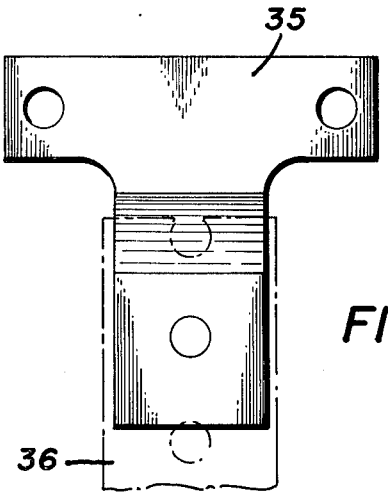
FIGS. 12 and 13 are front elevational and side elevational views, respectively, of another modification of the invention.
Figure 13:
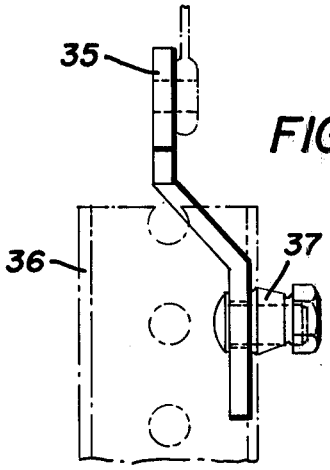

FIGS. 12 and 13 show a connector 35 having a main body that is not provided with tabs, but has spaced, parallel, side edges which fit snugly between the two opposite inside surfaces of the post 36. The main body is bolted against the inside surface by a bolt 37.

Figure 14:
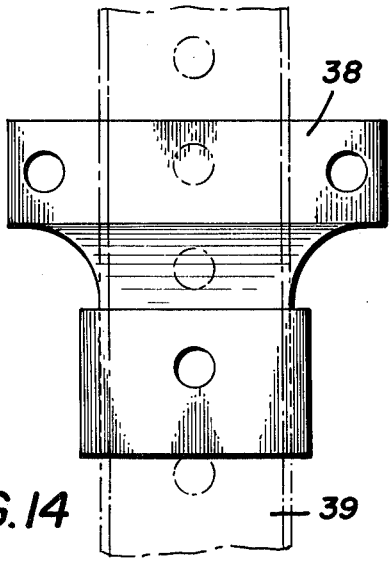
FIGS. 14 and 15 are front elevational and side elevational views, respectively, of a still further modified form of the invention.
Figure 15:
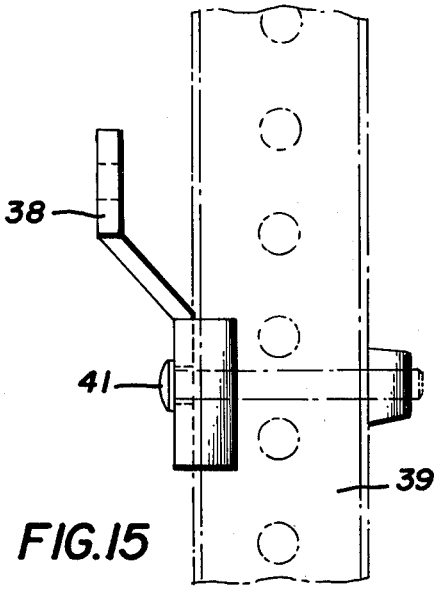

FIGS. 14 and 15 show a connector 38 in which the neck extends in the direction opposite that of the tabs, so that the rectangular plate lies in a plane which is spaced from and parallel to the exterior side surface to which the connector is bolted. The plate, therefore, lies away from the post and permits this connector to be used on the intermediate portion of the post.

In FIG. 10 it can be seen that the main body 27 of the connector 26 is connected to the post 25 by the bolt 34 and a nut 43. The nut has a frusto-conical portion 44 which lies against the main body of the connector 30 and a coaxial non-coextensive hexagonal portion 43. The two portions are joined by a frangible portion 46 of reduced cross-section that will shear at a predetermined tightening torque, thus leaving the conical portion 44 behind.

The operation and the advantages of the present invention will now be readily understood in view of the above description. The portions 14, 15, and 16 (shown in FIG. 5) are formed as a flat sheet metal blank. During the manufacturing operation, the bending takes place along the common line between the panels 17 and 18 in the center of the connector portion 16. The element then takes the form shown in FIGS. 2, 3, and 4. In assembling the invention on the post 13, the bottom edge of the sign 12 is bolted to the top of the post 13 by means of the apertures 23. The lower portion 15 of the connector element is then bolted to the upper edge portion of the sign 12. Then, the sign 11 is bolted to the upper portion 14 at its lower edge. The street sign structure 10 now has the complete form shown in FIG. 1. The result is a rugged structure in which the parts are simple and inexpensive to manufacture and which are not readily subject to deterioration by the weather. In order to assemble the sign structure it is only necessary to carry a supply of the connectors as well as a supply of the signs 11 and 12 and posts 13 along with suitable fasteners.

Instead of using the round tubular post shown in FIGS. 6, 7, and 8, it may be desirable to use the square cross-section hollow post of the type shown in FIGS. 9–15. The particular connector element shown in FIGS. 9, 10, and 11 bolts to the exterior of the post, the two connectors 26 and 30 that are used being exactly alike. The use of the bolt 34 with the frangible nut 43 allows the use of a nut and bolt without at the same time exposing the structure to disassembly by vandals. FIGS. 12 and 13 show a connecting structure which is somewhat simpler, also using the same type of frangible nut 37. In FIGS. 14 and 15 the connector 38 used with the fastener 41 on the post 39 allows the sign to be mounted at an intermediate portion of the post.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Street sign structure, comprising:
(a) a post, the upper end of which is provided with a generally flat portion,
(b) a lower sign, the lower edge portion of which is attached to said flat portion,
(c) an upper sign extending above and transversely of the lower sign, and
(d) a connector element having a flat generally rectangular lower portion attached to the upper edge portion of the lower sign, a flat generally rectangular upper portion attached to the lower edge portion of the upper sign, and a connector portion consisting of two flat panels integrally joined at a right angle, the upper edge of one of the panels being integrally connected to the lower edge of the upper portion and lying in the same plane as the upper portion, and the lower edge of the other panel integrally connected to the upper edge of the lower portion and lying in the same plane as the lower portion.

2. Street sign structure as recited in claim 1, wherein the main body of said post is tubular and of circular cross-section, the lower end of the post has a generally flat portion to prevent the post from being turned once it is in the ground.

3. Street sign as recited in claim 1, wherein the post is tubular and of square cross-section, and wherein a connector is provided having a flat main body adapted to be bolted to one surface of the post, having a rectangular plate provided in the two apertures and forming said upper flat portion for attachment to the lower edge of the lower sign, and having a neck extending between the main body and the rectangular plate at a substantial angle to both to hold them in spaced, parallel relationship.

4. Street sign structure as recited in claim 3, wherein two tabs are provided, each extending at a right angle to the main body, the main body being fastened by a bolt to one exterior side surface of the post with the tabs lying flat against the opposite parallel side surface of the post adjacent the said one side surface.

5. Street sign structure as recited in claim 4, wherein the neck extends in the same direction as the tabs, so that the rectangular plate resides in a plane extending centrally of the post.

6. Street sign structure as recited in claim 4, wherein the neck extends in the direction opposite that of the tabs, so that the rectangular plate resides in a plane spaced from the parallel to the said one exterior side surface away from the past.

7. Street sign structure as recited in claim 3, wherein the main body has spaced, parallel side edges which fit snugly between two opposite inside surfaces of the post which the main body bolted against the inside surface between them.

8. Street sign structure as recited in claim 3, wherein the main body is connected to the post by a nut and bolt, the nut having a frusto-conical portion and a coaxial, non-coextensive hexagonal portion, the two portions being joined by a portion of reduced cross-section that will shear at a predetermined tightening torque.

9. Street sign structure for use in supporting two flat rectangular signs at a right angle one above the other on a post, comprising:

(a) a flat rectangular upper portion having two apertures for connection to the lower edge part of the upper sign, (b) a flat rectangular lower portion having two apertures for connection to the upper edge part of the lower sign, and (c) a connector portion consisting of two generally rectangular panels integrally joined at a right angle so that the panels extend in transverse planes, the upper edge of one of the panels being integrally connected to the lower edge of the upper portion and the lower edge of the other panel being integrally connected to the upper edge of the lower portion, the two panels being joined along only a substantial portion of their heights, so that there is a first gap between the lower edge of the said one of the panels and the upper edge of the lower portion and a second gap between the upper edge of the said other panels and the lower edge of the said upper portion.

* * * * *